US007873512B2

(12) United States Patent
Oshikiri

(10) Patent No.: US 7,873,512 B2
(45) Date of Patent: Jan. 18, 2011

(54) SOUND ENCODER AND SOUND ENCODING METHOD

(75) Inventor: Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 1007 days.

(21) Appl. No.: 11/632,771

(22) PCT Filed: Jul. 14, 2005

(86) PCT No.: PCT/JP2005/013052

§ 371 (c)(1),
(2), (4) Date: Jan. 18, 2007

(87) PCT Pub. No.: WO2006/009075

PCT Pub. Date: Jan. 26, 2006

(65) Prior Publication Data

US 2008/0071523 A1 Mar. 20, 2008

(30) Foreign Application Priority Data

Jul. 20, 2004 (JP) ..... 2004-211589

(51) Int. Cl.
*G10L 19/00* (2006.01)

(52) U.S. Cl. ..... 704/212; 704/222; 704/220; 704/223

(58) Field of Classification Search ..... 704/222, 704/219, 220, 223, 207, 217, 212, 273, 221, 704/230, 229, 225, 240, 241, 211
See application file for complete search history.

(56) References Cited

U.S. PATENT DOCUMENTS 5,054,072 A * 10/1991 McAulay et al. ..... 704/207
5,327,520 A * 7/1994 Chen ..... 704/219
5,822,723 A * 10/1998 Kim et al. ..... 704/222

(Continued)

FOREIGN PATENT DOCUMENTS

JP 10260700 9/1998

(Continued)

OTHER PUBLICATIONS

PCT International Search Report dated Sep. 6, 2005.

(Continued)

*Primary Examiner*—Vijay B Chawan
(74) *Attorney, Agent, or Firm*—Dickinson Wright PLLC

(57) ABSTRACT

Even when a combination of the stegonography technique and prediction encoding is applied to sound encoding, a sound encoder does not cause deterioration in quality of decoded signals. In the device, an encoding section (102) outputs an encoding code (I) to a bit embedding section (104). A function extension encoding section (103) generates an encoding code (J) for information required for extending functions of the sound encoder (100) and outputs it to the bit embedding section (104). The bit embedding section (104) embeds information on the encoding code (J) into a part of bits of the encoding code (I) and outputs the resultant encoding code (I'). A synchronization information generating section (106) generates synchronization information according to the encoding code (I') after the bit embedding and outputs the synchronization information to the encoding section (102). The encoding section (102) updates the internal state and the like on the basis of the synchronization information and encodes the next digital sound signal (X).

12 Claims, 14 Drawing Sheets

U.S. PATENT DOCUMENTS

| | | | | |
|---|---|---|---|---|
| 6,182,030 | B1 * | 1/2001 | Hagen et al. | 704/201 |
| 6,697,776 | B1 * | 2/2004 | Fayad et al. | 704/233 |
| 7,009,533 | B1 * | 3/2006 | Wegener | 341/76 |
| 7,263,480 | B2 * | 8/2007 | Minde et al. | 704/219 |
| 7,574,351 | B2 * | 8/2009 | Anandakumar et al. | 704/201 |
| 7,653,536 | B2 * | 1/2010 | Tackin et al. | 704/214 |
| 2003/0154073 | A1 | 8/2003 | Ota | |
| 2003/0191635 | A1 * | 10/2003 | Minde et al. | 704/220 |
| 2004/0101160 | A1 | 5/2004 | Kunisa | |
| 2007/0294084 | A1 * | 12/2007 | Cross et al. | 704/251 |

FOREIGN PATENT DOCUMENTS

| | | | |
|---|---|---|---|
| JP | 2003316670 | | 11/2003 |
| JP | 2004173237 | | 6/2004 |
| WO | 98/33324 | | 7/1998 |
| WO | WO -98/33324 | * | 7/1998 |

OTHER PUBLICATIONS

K. Matsui; "Denshi Sukashi no Kiso," Morikita Shuppan Co., Ltd., Aug. 21, 1998, pp. 176-184.

M. Iwakiri, et al.; "Denshi Enso no Hanzatsuonka to Ongen Fugo eno Denshi Sukashi," Transactions of Information Processing Society of Japan, Feb. 15, 2002, vol. 43, No. 2, pp. 225-233.

N. Aoki; "A Band Widening Technique for VoIP Speech Using Steganography," Technical Report of IEICE, The Institute of Electronics, Information and Communication Engineers, SP2003-72, Aug. 2003, pp. 49-52.

European Search Report dated Jul. 22, 2008.

N. Komaki et al: "A Packet Loss Concealment Technique for VOIP Using Steganography" IEICE Transactions on Fundamentals of Electronics, Communications and Computer Sciences, Engineering Sciences Society, Tokyo, JP, vol. E86-A, No. 8, Aug. 1, 2003, pp. 2069-2072.

Heping Ding: "Wideband audio over narrowband low—resolution media" Acoustics, Speech, and Signal Processing, 2004, Proceedings.(ICASSP '04). IEEE International Conference on Montreal Quebec, Canada May 17-21, 2004, Piscataway, NJ, USA, IEEE, vol. 1, May 17, 2004, pp. 489-492.

* cited by examiner

SOUND ENCODER AND SOUND ENCODING METHOD

TECHNICAL FIELD

The present invention relates to a speech encoding apparatus and speech encoding method.

BACKGROUND ART

A speech encoding technology that compresses a speech signal or audio signal at a low bit rate is important to effectively use transmission path capacity in a communication system. In recent years, as principal application of the speech encoding technology, communication systems typified by a VoIP (Voice over IP) network and mobile telephone network draw attention. VoIP is a speech communication technology that uses a packet communication network using IP (Internet Protocol) stores an encoded code of a speech signal in a packet, and exchanges packets with a communicating party.

In the speech communication system, in order to establish speech communication with the communicating party, the communication terminal apparatus that the user has have to accurately interpret and implement decoding processing of the encoded code generated by the communication terminal apparatus that the communicating party has. Therefore, after deciding the specification of a codec for the speech communication system once, it is not easy to change this specification. This is because, if the specification of the codec is tried to be changed, it is necessary to change the functions of both encoding apparatus and decoding apparatus. When it is considered that some kind of a new extension function is provided to the encoding apparatus, and information about the extension function is transmitted together, it is necessary to revise the specification of the codec of the speech communication system, and therefore a cost increases substantially.

In patent document 1 or non-patent document 1, speech encoding methods of embedding additional information in an encoded code using the steganographic technology are disclosed. For example, even if the least significant bit of the encoded code is changed to some extent, a person cannot auditorily perceive the difference. In order to add new information at a transmission apparatus, bits indicating additional information are embedded in the least significant bit of speech data that does not cause auditory problems, and this data is transmitted. According to this technology, even if the encoding apparatus is provided with some kind of an extension function, and information about this extension function is embedded in the original encoded code as an extension code and transmitted, there is no case where the decoding apparatus cannot perform decoding. Namely, it is possible to interpret this encoded code and generate a decoding signal at the decoding apparatus that is not compatible with the extension function as well as at the decoding apparatus compatible with the extension function.

For example, in the above-described patent document 1, as information about the above-described extension function, information for applying a compensation technology for suppressing deterioration in speech quality due to a packet loss etc. is embedded, and further, in the above-described non-patent document 1, information for extending a narrow band signal to a wide band signal is embedded.

Patent Document 1: Japanese Patent Application Laid-open No. 2003-316670.

Non-patent document 1: Aoki et. al., "A band widening technique for VoIP speech using steganography", IEICE Technical Report, SP2003-72, pp. 49-52.

DISCLOSURE OF INVENTION

Problems to be Solved by the Invention

Typically, when a time-correlated signal such as a speech signal is quantized, by predicting an amplitude value of a sample for an encoding target from amplitude values of past samples and using predictive encoding that carries out encoding after eliminating time redundancy, it is possible to implement a lower bit rate. Here, specifically, in the prediction, the amplitude value of the sample for the encoding target is estimated by multiplying the amplitude values of past samples by specific coefficients. If the residual in which a prediction value is subtracted from the amplitude value for the encoding target, is quantized, it is possible to perform encoding with a less code amount than direct quantization of the amplitude value of the sample for the encoding target and achieve a low bit rate. As coefficients for multiplying the amplitude values of the past samples, there are, for example, LPC (Linear Predictive Coding) coefficients.

However, for example, in either patent document 1 or non-patent document 1 described above, the used codec is an ITU-T recommended G.711. This G.711 is an encoding method for directly quantizing the amplitude value of the sample, and the above-described predictive encoding is not carried out. When it is considered to combine the steganographic technology and predictive encoding, the following problems occur.

In the speech encoding apparatus, the predictive encoding is a part of encoding processing, and therefore is carried out within an encoding section. An extension code is embedded in the encoded code generated by the encoding section and is outputted from the speech encoding apparatus. On the other hand, in the speech decoding apparatus, predictive encoding is carried out on the encoded code in which the extension code has already been embedded and the speech signal is then decoded. Namely, in the speech encoding apparatus, the target of predictive encoding is that the code before embedding the extension code. On the other hand, in the speech decoding apparatus, the target is the code after embedding the extension code. As a result, there is a difference between the internal state of the predictive section within the speech encoding apparatus and the internal state of the predictive section within the speech decoding apparatus, and the quality of the decoded signal deteriorates. This occurs peculiarly in the case of combining the steganographic technology and the predictive encoding.

It is therefore an object of the present invention to provide a speech encoding apparatus and speech encoding method that does not cause deterioration in quality of a decoded signal even when a combination of the steganographic technology and the predictive encoding is applied to speech encoding.

Means for Solving the Problem

A speech encoding apparatus of the present invention adopts a configuration having: an encoding section that generates a code from a speech signal using predictive encoding; an embedding section that embeds additional information in the code; a predictive decoding section that carries out decoding corresponding to the predictive encoding of the encoding section using the code in which the additional information is embedded; and a synchronization section that synchronizes a parameter used in the predictive encoding of the encoding section with a parameter used in the decoding of the predictive decoding section.

ADVANTAGEOUS EFFECT OF THE INVENTION

According to the present invention, it is possible to prevent deterioration in quality of the decoded signal even when a combination of the steganographic technology and the predictive encoding is applied to speech encoding.

BEST MODE FOR CARRYING OUT THE INVENTION

Embodiments of the present invention will be described in detail below with reference to the accompanying drawings.

Embodiment 1

Figure 1:
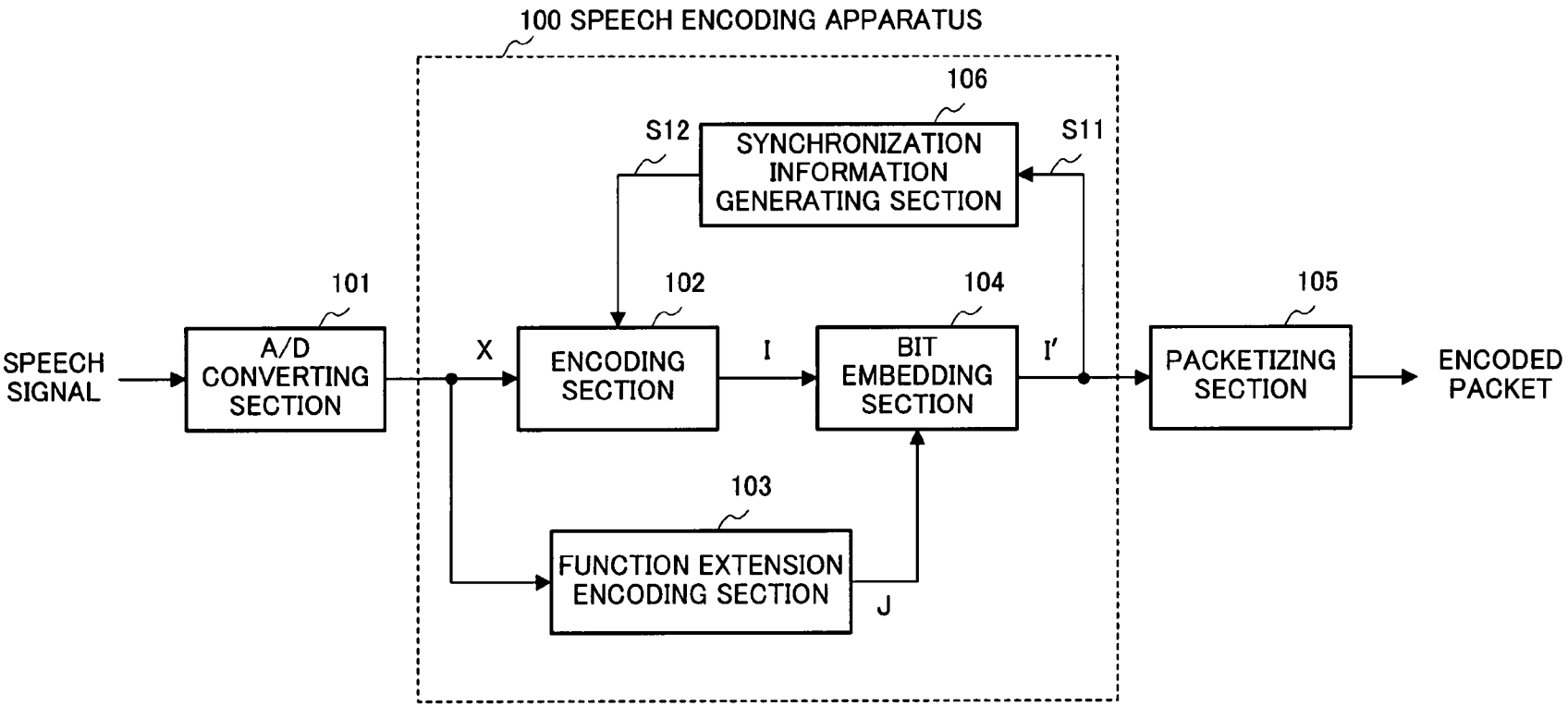
FIG. 1 is a block diagram showing the main configuration of a packet transmission apparatus according to Embodiment 1.

FIG. 1 is a block diagram showing the main configuration of the packet transmission apparatus provided with speech encoding apparatus 100 according to Embodiment 1 of the present invention.

In this embodiment, a case will be described as an example where speech encoding apparatus 100 carries out speech encoding using an ADPCM (Adaptive Differential Pulse Code Modulation) scheme. In the ADPCM scheme, an encoding efficiency is enhanced by achieving adaptation using backward prediction at a predictive section and an adaptive section. For example, G.726 that is an ITU-T standard specification is a speech encoding method based on the ADPCM scheme. It is possible to encode a narrow band signal at 16 to 40 kbit/s, and achieve a lower bit rate than G.711 that does not use prediction. Further, similarly, G.722 is an encoding method based on the ADPCM scheme, and is capable of encoding the wide band signal at a bit rate of 48 to 64 bit/s.

The packet transmission apparatus according to this embodiment has A/D converting section 101, encoding section 102, function extension encoding section 103, bit embedding section 104, packetizing section 105 and synchronization information generating section 106, and each section operates as follows.

A/D converting section 101 converts an input speech signal to digital, and outputs digital speech signal X to encoding section 102 and function extension encoding section 103. Encoding section 102 decides encoded code I so that quantization distortion between digital speech signal X and the decoded signal generated by the decoding apparatus becomes minimum, or so that the distortion is difficult for a person to perceive auditorily, and outputs the result to bit embedding section 104.

On the other hand, function extension encoding section 103 generates encoded code J of information necessary for the function extension of speech encoding apparatus 100, and outputs the code to bit embedding section 104. As the extension function, for example, frequency band is extended from narrow band (frequency band of 0.3 to 3.4 kHz, that is, signal frequency band used in a typical telephone line) to wide band (frequency band of 0.05 to 7 kHz, in which naturalness and clarity increase more than the narrow band), or error compensation is carried out using the next packet even when a current packet is dropped (lost) at the decoding apparatus, and compensation information is generated so that deterioration in quality is suppressed to a minimum.

Bit embedding section 104 embeds information of encoded code J obtained from function extension encoding section 103 in bits of part of encoded code I obtained from encoding section 102, and outputs encoded code I' obtained as a result to packetizing section 105. Packetizing section 104 packetizes encoded code I', and, for example, in the case of VoIP, packets are transmitted to the communicating party via an IP network. Synchronization information generating section 106 generates synchronization information as described later based on encoded code I' after bits are embedded, and outputs the information to encoding section 102. Encoding section 102 updates an internal state etc. based on this synchronization information, and encodes next digital speech signal X.

The bit rates of I and I' are the same. Encoding section 102 adopts G.726, and, when extension code J is embedded in the LSB (Least Significant Bit) of encoded code I, it is possible to embed extension code J at a bit rate of 8 kbit/s.

The procedure of speech encoding processing according to this embodiment is arranged as follows.

First, an internal state of predictive section 132, prediction coefficients used at predictive section 132, and a quantization code of one sample previous used at adaptive section 133 are supplied from synchronization information generating section 106 to encoding section 102. Next, encoding processing is carried out at encoding section 102, and information about an extension function is encoded at function extension encoding section 103. After this, encoded code I' is generated at bit embedding section 104, outputted, and provided to synchronization information generating section 106. Synchronization information generating section 106 updates the internal state of predictive section 132, prediction coefficients used at predictive section 132, and the quantization code of one sample previous used at adaptive section 133, and supplies the results to encoding section 102, and encoding section 102 is prepared for next input digital signal X.

Figure 2:
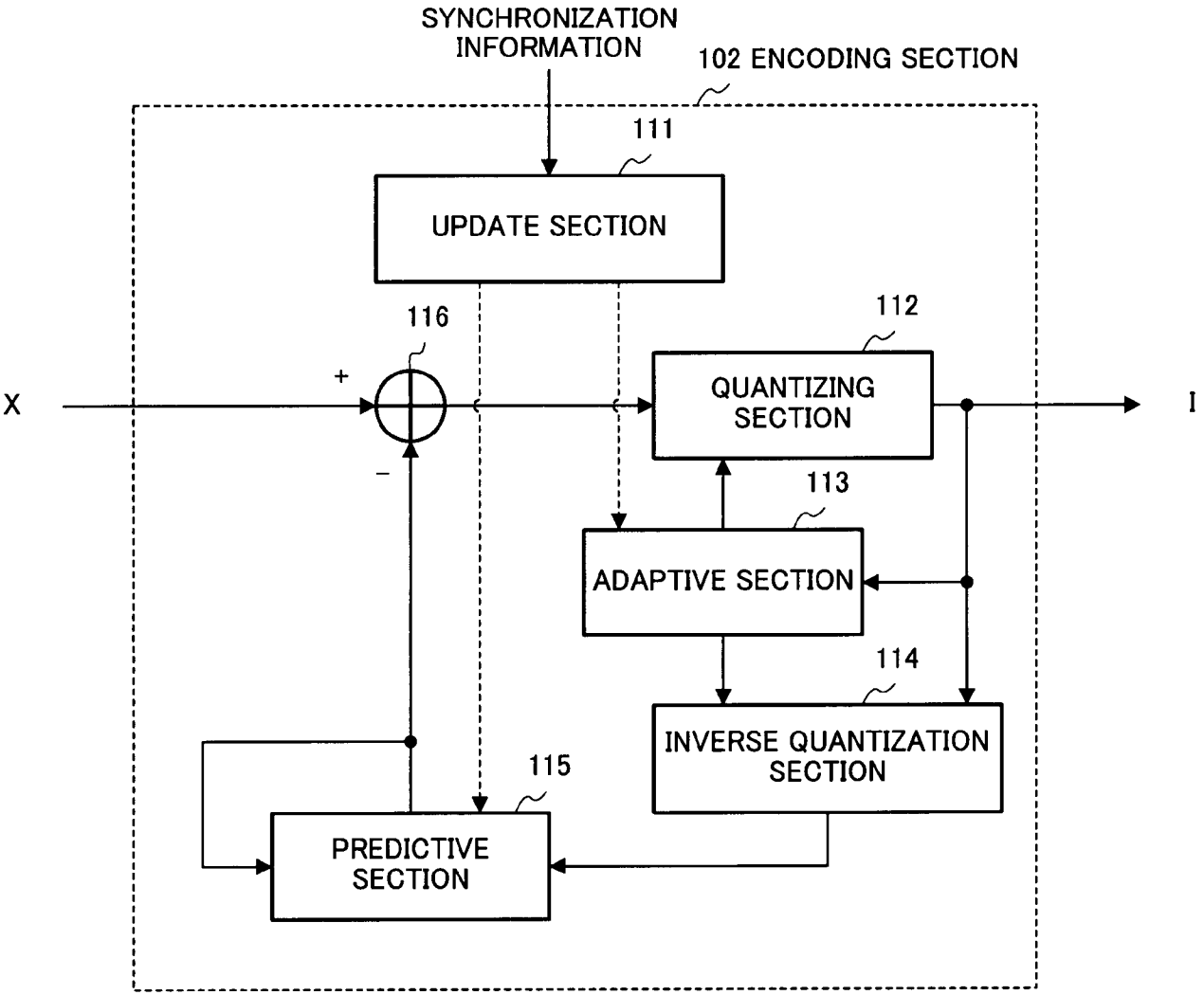
FIG. 2 is a block diagram showing the main configuration within an encoding section according to Embodiment 1.

FIG. 2 is a block diagram showing the main configuration within encoding section 102.

Synchronization information is supplied from synchronization information generating section 106 shown in FIG. 1 to update section 111. Update section 111 then updates the prediction coefficients used at predictive section 115, the internal state of predictive section 115, and the quantization code of one sample previous used at adaptive section 113. The processing after encoding section 102 is carried out using updated adaptive section 113 and predictive section 115.

Digital speech signal X is supplied to encoding section 102 and inputted to subtraction section 116. Subtraction section 116 then subtracts the output of predictive section 115 from digital speech signal X and supplies this error signal to quantizing section 112. Quantizing section 112 then quantizes the error signal using a quantization step size decided using the quantization code of one sample previous, outputs this encoded code I, and supplies this to adaptive section 113 and inverse quantization section 114. Inverse quantization section 114 decodes the error signal after quantization in accordance with the quantization step size supplied from adaptive section 113, and provides this signal to predictive section 115. Based on an amplitude value of the error signal indicated in the quantization code of one sample previous, adaptive section 113 enlarges a quantization step width in the case where the amplitude value is large, and reduces the quantization step width in the case where the amplitude value is small. Predictive section 115 then carries out prediction in accordance with the following equation (1) using the error signal after quantization and a prediction value of the input signal.

$$y(n) = u(n) - \sum_{i=1}^{L} a(i) \cdot y(n-i) - \sum_{i=1}^{M} b(i) \cdot u(n-i) \quad (1)$$

Here, y(n) is a prediction value of the input signal of an nth sample, u(n) is an error signal after quantization of an nth sample, a(i) is an AR prediction coefficient, b(i) is a prediction coefficient, and L and M are numbers of AR prediction and MA prediction, respectively. Next, a(i) and b(i) are sequentially updated by adaptation using backward prediction.

Figure 3:
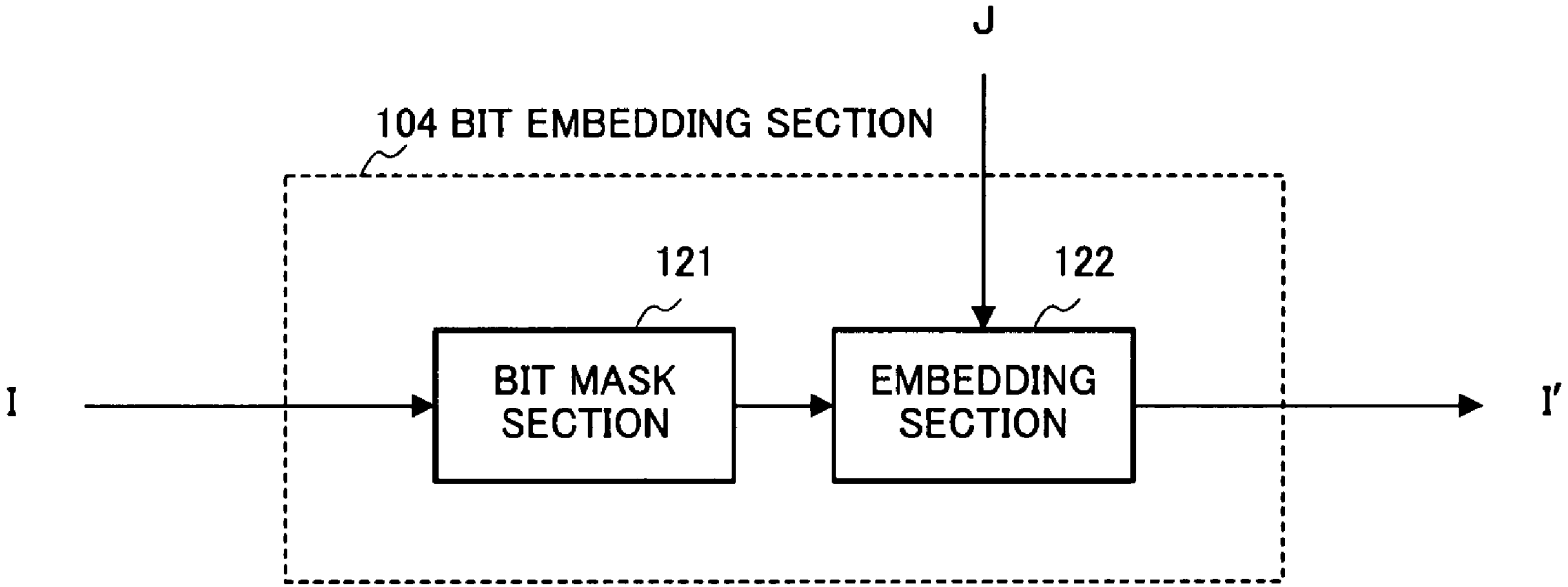
FIG. 3 is a block diagram showing the main configuration within a bit embedding section according to Embodiment 1.

FIG. 3 is a block diagram showing the main configuration within bit embedding section 104.

Bit mask section 121 masks a predetermined bit position of inputted encoded code I and always sets a value of the bit of this position to zero. Embedding section 122 embeds information for extension code J in this bit position of the masked encoded code, replaces the value of the bit of this position with extension code J, and outputs encoded code I' after embedding.

Figure 4:
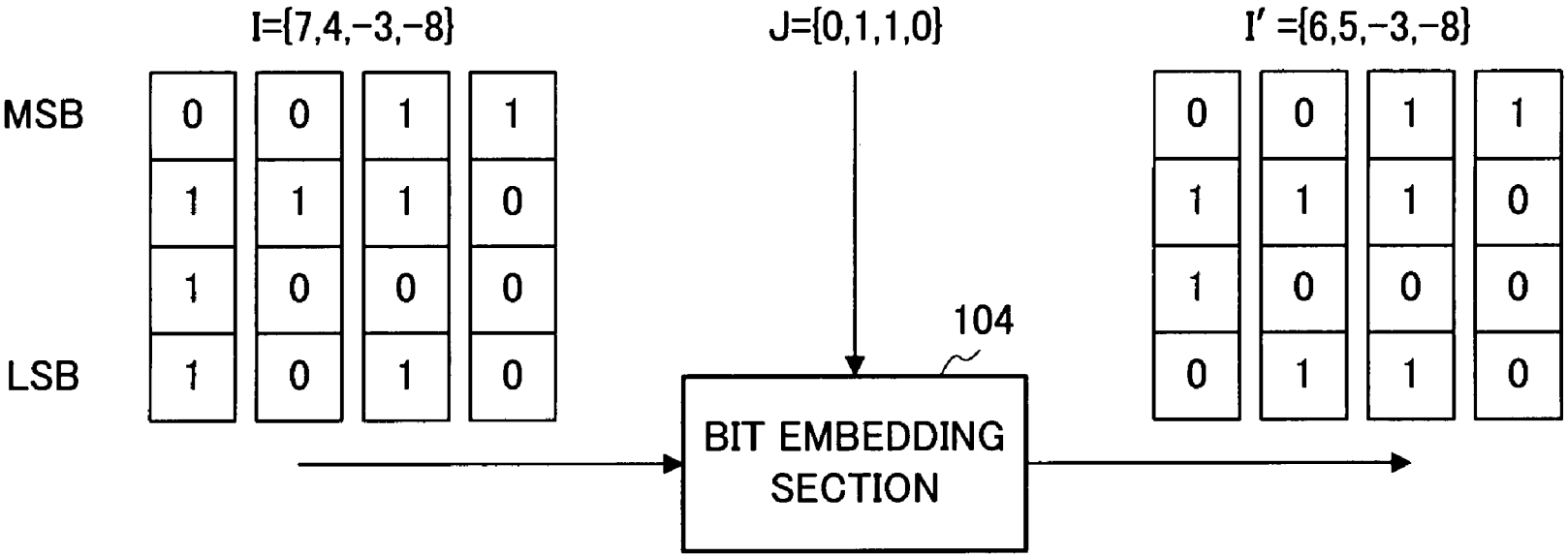
FIG. 4 shows an example of a bit configuration of a signal inputted and outputted from the bit embedding section according to Embodiment 1.

FIG. 4 shows an example of a bit configuration of a signal inputted and outputted from bit embedding section 104. Further, MSB is an abbreviation of Most Significant Bit.

Here, a case will be described as an example where four bits of extension code J are embedded for four bits of encoded code (four words) and outputted as encoded code I'. The bit position where the extension code is embedded is the LSB. Encoded code I is then subjected to processing of "Itmp=I&(OxE)" at bit mask section 121 so as to give Itmp. Itmp is then subjected to processing of "I'=Itemp|J" at embedding section 122 so as to give encoded code I'. Here, in this processing, "&" is the logical product and "|" is the logical sum. In this example, in the case of processing of 8 kHz sampling data, the bit rate is 32 kbit/s, and it is possible to embed additional information for just a bit rate of 8 kbit/s.

Here, a case has been described as an example where encoding is performed with four bits per one sample, and the extension code is embedded in the LSB, but this is by no means limiting. For example, if the extension code is embedded every one sample, it is possible to embed additional information for a bit rate of 4 kbit/s. Further, if the extension code is embedded in a lower two bits, the bit rate for additional information is 16 kbit/s. It is possible to set the bit rate of the additional information with a comparatively great flexibility. Further, it is possible to adaptively change the number of embedded bits according to the properties of the inputted speech signal. In this case, information about the number of embedded bits is separately reported to the decoding apparatus.

Figure 5:
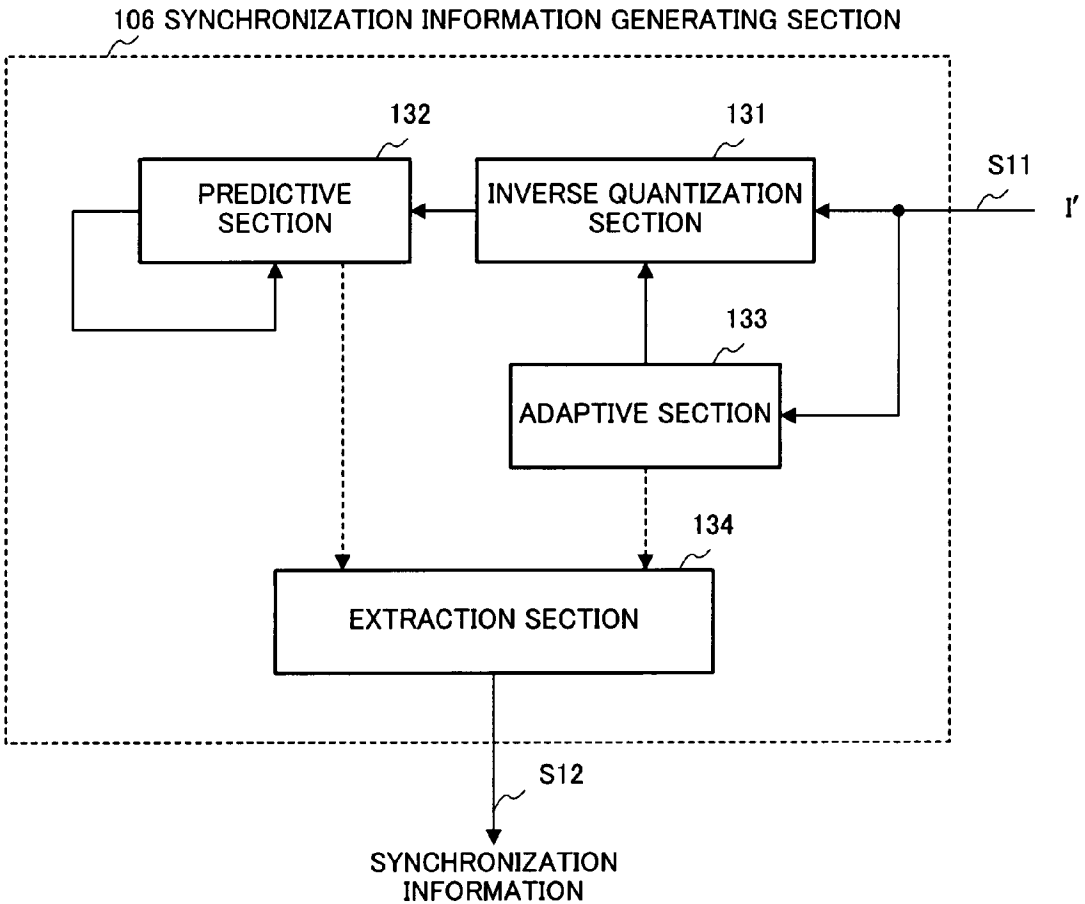
FIG. 5 is a block diagram showing the main configuration within a synchronization information generation section according to Embodiment 1.

FIG. 5 is a block diagram showing the main configuration within synchronization information generating section 106. Synchronization information generating section 106 carries out decoding processing as follows using encoded code I' that is the output of bit embedding section 104.

First, the residual signal after quantization is decoded at inverse quantization section 131 using quantization step information provided from adaptive section 133 and is supplied to predictive section 132. At predictive section 132, the internal state and prediction coefficients shown in equation (1) are updated using the residual signal after quantization and the signal outputted in processing for the previous time of predictive section 132 in accordance with the equation (1). Based on an amplitude value for the error signal, adaptive section 133 enlarges the quantization step width in the case where the amplitude value is large, and reduces the quantization step width in the case where the amplitude value is small. After this series of processing is carried out, extraction section 134 extracts the internal state of predictive section 132, the prediction coefficients used at predictive section 132, and the quantization code of one sample previous used at adaptive section 133 and outputs the results as synchronization information.

The basic operation of synchronization information generating section 106 is such that processing corresponding to the decoding section existing within the speech decoding apparatus—processing of the decoding section corresponding to encoding section 102—is carried out in a similar manner within speech encoding apparatus 100 using encoded code I', and parameters (prediction coefficients used at predictive section 132, internal state of predictive section 132, and the quantization code of one sample previous used at adaptive section 133) relating to predictive encoding obtained from these results are reflected in predictive encoding (processing of adaptive section 113 and predictive section 115) occurring at encoding section 102. Namely, at adaptation section 113 and predictive section 115 within encoding section 102, parameters relating to predictive encoding generated based on encoded code I' are reported from synchronization information generating section 106 as synchronization information, so that it is possible to synchronize (conform) the prediction coefficients used at the predictive section within the speech decoding apparatus, the internal state of this predictive section, and the quantization code of one sample previous used at the adaptive section within the speech decoding apparatus with the prediction coefficients used at predictive section 115 within encoding section 102, the internal state of predictive section 115, and the quantization code of one sample previous used at adaptive section 113. In other words, parameters relating to predictive encoding can be obtained based on the same encoded code I' at both speech encoding apparatus 100 and the speech decoding apparatus corresponding to speech encoding apparatus 100. By adopting such a configuration, it is possible to avoid deterioration in speech quality of the decoded signal obtained by the speech decoding apparatus.

In this way, according to this embodiment, parameters relating to predictive encoding used at the predictive section within the encoding section are updated using the code after bits of the extension code are embedded, so that it is possible to synchronize parameters used in the predictive section within the speech encoding apparatus with parameters used at the predictive section within the speech decoding apparatus, and prevent deterioration in speech quality of the decoded signal.

Moreover, in the above configuration, in the case of an encoding method using an ADPCM scheme, bit embedding section 104 embeds part or all of additional information in the LSB of the encoded code.

In this embodiment, a case has been described as an example where speech encoding apparatus 100 is provided to the packet transmission apparatus, but speech encoding apparatus 100 may also be provided to a non-packet communication type mobile telephone. In this case, a line-exchange type communication network is used instead of packet communication, and therefore a multiplex section is provided instead of packetizing section 105.

Further, it is not necessary for the speech decoding apparatus corresponding to speech encoding apparatus 100—the speech decoding apparatus that decodes encoded packets outputted from speech encoding apparatus 100—to be compatible with the function extension.

Further, when information other than the encoded code, such as control information of the communication system, is communicated (upon signaling), by providing a function for transmitting the embedding position of the additional information and the amount of embedding to the communication terminal apparatus which is a communicating party, it is possible to obtain the following advantages.

For example, at the speech encoding apparatus, it is also possible to determine the conditions of the communication terminal apparatus of the communicating party (transmission errors occur easily/with difficulty), and decide the embedding position upon signaling. As a result, it is possible to improve robustness to transmission errors.

Further, for example, it is also possible to set the size of the encoded code of the extension function at the terminal. By this means, it is possible for the user of the terminal to select the extent of the addition function. For example, it is possible to select a frequency band width of the extended band from either 7 kHz, 10 kHz or 15 kHz.

Figure 6A:
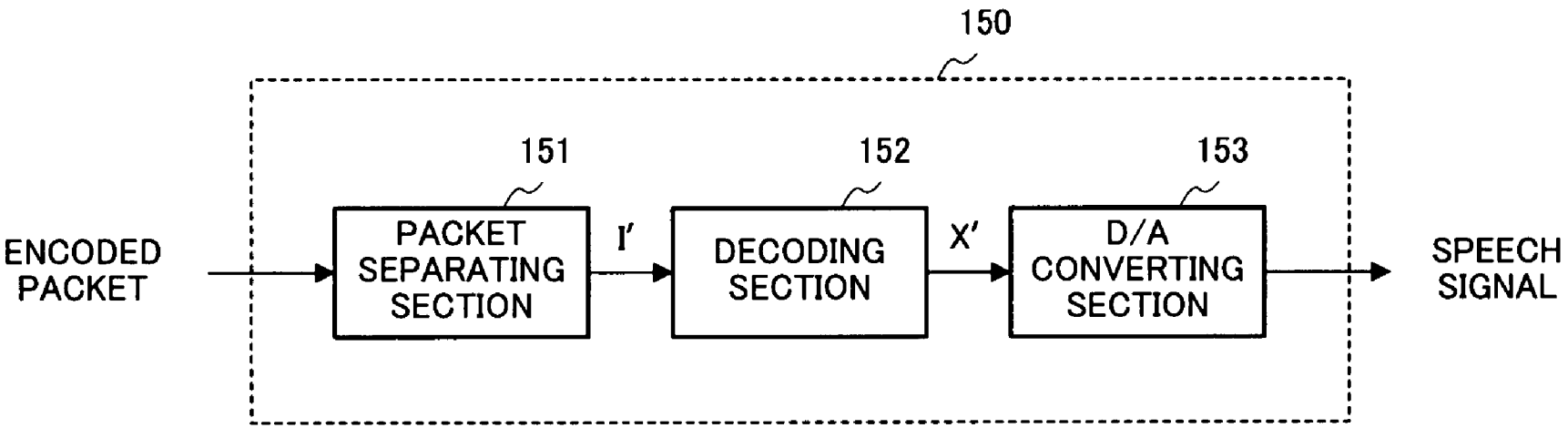
FIG. 6A is a block diagram showing a configuration example of a speech decoding apparatus according to Embodiment 1.
Figure 6B:
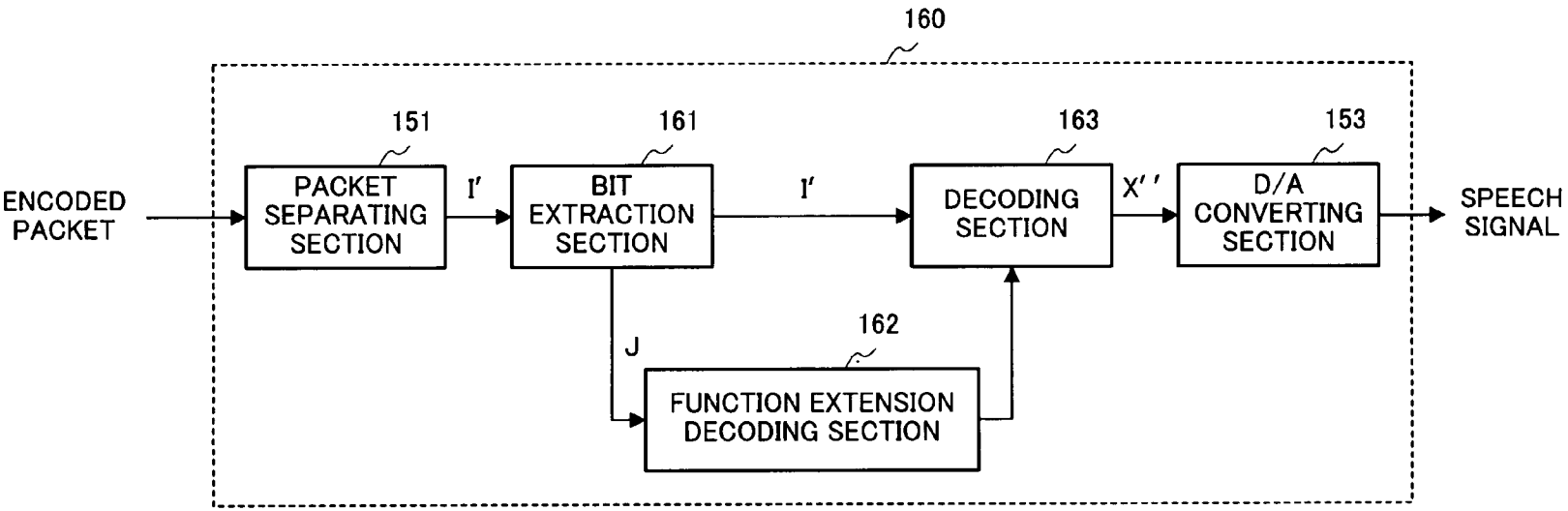
FIG. 6B is another block diagram showing a configuration example of the speech decoding apparatus according to Embodiment 1.

FIG. 6A and FIG. 6B are block diagrams showing configuration examples of the speech decoding apparatus corresponding to speech encoding apparatus 100. FIG. 6A shows an example of speech decoding apparatus 150 that is not compatible with the function extension, and FIG. 6B shows an example of speech decoding apparatus 160 compatible with this function extension. Components that are identical are assigned the same reference numerals.

At speech decoding apparatus 150, packet separating section 151 separates encoded code I' from the received packet. Decoding section 152 then carries out decoding processing of encoded code I'. D/A converting section 153 converts decoded signal X' obtained as a result to an analog signal, and outputs a decoded speech signal. On the other hand, at speech decoding apparatus 160, bit extraction section 161 extracts extension code bit J from encoded code I' outputted from packet separating section 151. Function extension decoding section 162 decodes extracted bit J, obtains information relating to the extension function, and outputs the information to decoding section 163. Decoding section 163 decodes encoded code I' (the same as the encoded code outputted from packet separating section 151) outputted from bit extraction section 161 using the extension function based on information outputted from function extension decoding section 162. The encoded code inputted to decoding sections 152 and 163 is also I' in both cases, and the difference is that encoded code I' is decoded using the extension function, or is encoded without using the extension function. At this time, the speech signal obtained by speech decoding apparatus 160 and the speech signal obtained by speech decoding apparatus 150 are in a state in which a transmission path error occurs in the information of the LSB. As a result, deterioration of the speech quality occurs in the decoded signal due to LSB reception errors, but the extent of this speech deterioration is small.

Embodiment 2

The speech encoding apparatus according to Embodiment 2 of the present invention carries out speech encoding using the CELP scheme. As typical examples of CELP, there are G.729, AMR, and AMR-WB, etc. The speech encoding apparatus has the same basic configuration as speech encoding apparatus 100 shown in Embodiment 1, and a description of the same portions will be omitted.

Figure 7:
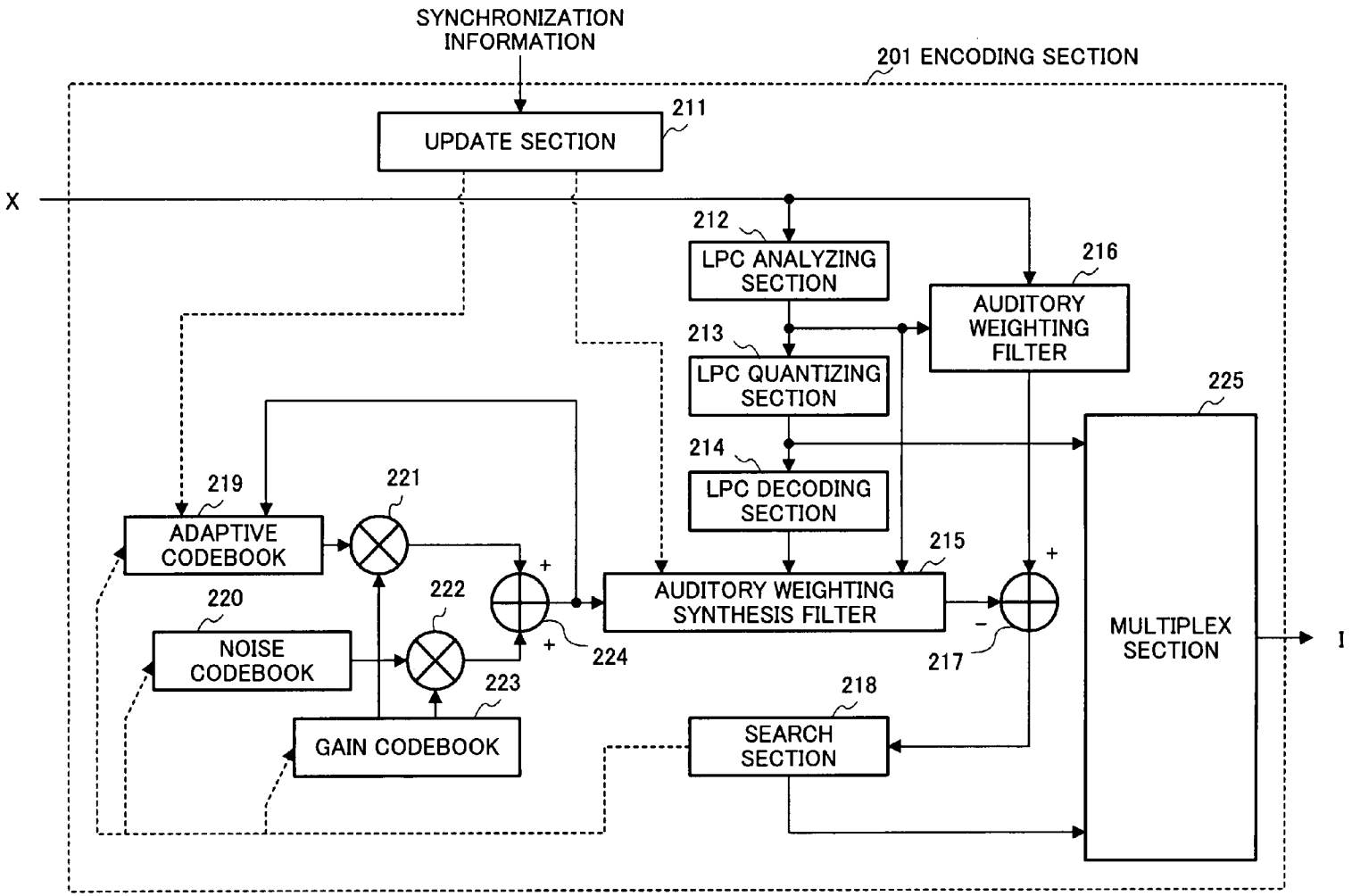
FIG. 7 is a block diagram showing the main configuration of an encoding section according to Embodiment 2.

FIG. 7 is a block diagram showing the main configuration of encoding section 201 within the speech encoding apparatus according to this embodiment.

Information relating to the internal states of adaptive codebook 219 and auditory weighting synthesis filter 215 is provided to update section 211. Update section 211 then updates information relating to the internal states of adaptive codebook 219 and auditory weighting synthesis filter 215.

LPC coefficients for the speech signal inputted to encoding section 201 is then obtained at LPC analyzing section 212. The LPC coefficients are used in order to improve auditory quality, and are provided to auditory weighting filter 216 and auditory weighting synthesis filter 215. Further, at the same time, the LPC coefficients are also supplied to LPC quantizing section 213, and LPC quantizing section 213 converts the LPC coefficients to a parameter appropriate for quantization, such as LSP coefficients, and carries out quantization. An index obtained by this quantization is then provided to multiplex section 225 and LPC decoding section 214. LPC decoding section 214 calculates the LSP coefficients after quantization from the encoded code and converts to LPC coefficients. In this way, the LPC coefficients after quantization are obtained. The LPC coefficients after this quantization are then supplied to auditory weighting synthesis filter 215, and used at adaptive codebook 219 and noise codebook 220.

Auditory weighting filter 216 assigns a weight to the input speech signal based on the LPC coefficients obtained by LPC analyzing section 212. This is carried out with the object of carrying out spectrum re-shaping so that a quantization distortion spectrum is masked with the spectrum envelope of the input signal.

Next, a method for searching an adaptive vector, adaptive vector gain, noise vector and noise vector gain will be described.

Adaptive codebook 219 holds an excitation signal generated in the past as an internal state, and generates an adaptive vector by repeating this internal state at a desired pitch period. It is appropriate that a range of a pitch period is between 60 Hz to 400 Hz. Further, noise codebook 220 outputs the noise vector stored in advance in a storage area or a vector generated in accordance with a rule without having a storage area like an algebraic structure, as a noise vector. An adaptive vector gain multiplied by the adaptive vector and a noise vector gain multiplied by the noise vector are outputted from gain codebook 223, and the gains are multiplied by the vectors at multipliers 221 and 222.

Adder 224 adds the adaptive vector multiplied by the adaptive vector gain and the noise vector multiplied by the noise vector gain, generates an excitation signal, and supplies the signal to auditory weighting synthesis filter 215. Auditory weighting synthesis filter 215 generates an auditory weighting synthesis signal via the excitation signal and provides the auditory weighting synthesis signal to subtracter 217. Subtracter 217 subtracts the auditory weighting synthesis signal from an auditory weighting input signal and supplies the signal after subtraction to search section 218. Search section 218 efficiently searches a combination of the adaptive vector, adaptive vector gain, noise vector and noise vector gain, in which distortion defined from the signal after subtraction becomes minimum, and transmits these encoded codes to multiplex section 225.

Search section 218 then decides index i, j, m or index i, j, m, n, in which distortion defined by following equations (2) and (3) becomes minimum, and transmits these to multiplex section 225.

$$E = \sum_{k=1}^{NL} (t(k) - \beta_m \cdot p_i(k) - \gamma_m e_j(k))^2 \tag{2}$$

$$E = \sum_{k=1}^{NL} (t(k) - \beta_m \cdot p_i(k) - \gamma_n e_j(k))^2 \tag{3}$$

Here, t(k) is an auditory weighting input signal, $p_i(k)$ is a signal obtained by passing an ith adaptive vector through an auditory weighting synthesis filter, $e_j(k)$ is a signal obtained by passing a jth noise vector through the auditory weighting synthesis filter, and β and γ are adaptive vector gain and noise vector gain, respectively. The configuration of the gain codebook is different between equation (2) and equation (3). In the case of equation (2), the gain codebook is expressed as a vector having elements of adaptive vector gain $\beta_m$ and noise vector gain $\gamma_m$, and index m for specifying a vector is decided. In the case of equation (3), the gain codebook has adaptive vector gain $\beta_m$ and noise vector gain $\gamma_n$ independently, and the indexes m and n are decided independently.

After all of indexes are decided, multiplex section 225 multiplexes the indexes into one and generates and outputs the encoded code.

Figure 8:
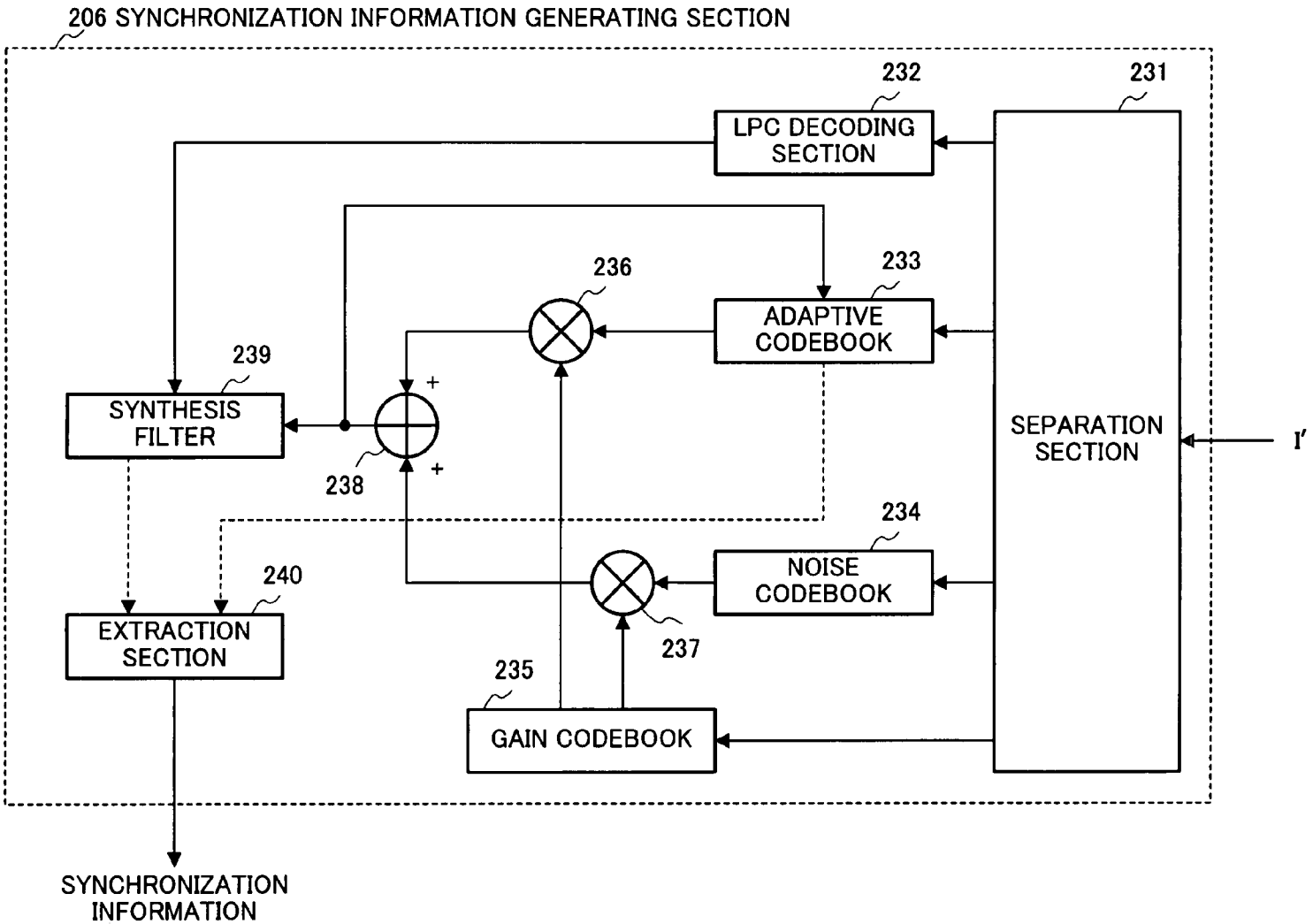
FIG. 8 is a block diagram showing the main configuration within a synchronization information generation section according to Embodiment 2.

FIG. 8 is a block diagram showing the main configuration within synchronization information generating section 206 according to this embodiment.

The basic operation of synchronization information generating section 206 is the same as synchronization information generating section 106 shown in Embodiment 1. Namely, processing of the decoding section existing within the speech decoding apparatus is carried out in a similar manner within the speech encoding apparatus using encoded code I', and an adaptive codebook and the internal state of a synthesis filter (with auditory weight) obtained as a result are reflected to adaptive codebook 219 and auditory weighting synthesis filter 215 within encoding section 201. As a result, it is possible to prevent quality deterioration in the decoded signal.

Separating section 231 separates the encoded code from inputted encoded code I' and supplies the code to adaptive codebook 233, noise codebook 234, gain codebook 235 and LPC decoding section 232. At LPC decoding section 232, the LPC coefficients are decoded using the supplied encoded code and supplied to synthesis filter 239.

Adaptive codebook 233, noise codebook 234 and gain codebook 235 decode adaptive vector q(k), noise vector c(k), adaptive vector gain $\beta_q$ and noise vector gain $\gamma_q$, respectively, using the encoded code. Multiplier 236 multiplies the adaptive vector gain by the adaptive vector, multiplier 237 multiplies the noise vector gain by the noise vector, and adder 238 adds the signals after the respective multiplications, and generates an excitation signal. When the excitation signal is expressed as ex (k), excitation signal ex(k) can be obtained from following equation (4).

$$ex(k)=\beta_q \cdot q(k)+\gamma_q \cdot c(k) \tag{4}$$

Next, synthesis signal syn(k) is generated in accordance with the following equation (5) at synthesis filter 239 using the decoded LPC coefficients and excitation signal ex(k).

$$syn(k) = ex(k) + \sum_{i=1}^{NP} \alpha_q(i) \cdot syn(k-i) \tag{5}$$

Here, $\alpha_q(i)$ is the decoded LPC coefficient and NP represents a number of the LPC coefficients. Next, the internal state of adaptive codebook 233 is updated using excitation signal ex(k).

After this series of processing is carried out, extraction section 240 extracts and outputs the internal states of adaptive codebook 233 and synthesis filter 239.

According to this embodiment, when speech encoding is carried out using the CELP scheme, it is possible to embed part or all of the additional information in a code indicating a CELP excitation source. In this way, it is possible to obtain the same advantages as Embodiment 1.

Here, a case has been described where the internal states of adaptive codebook 219 and auditory weighting synthesis filter 215 are used, but, when prediction is used in other processing, for example, LPC decoding, noise codebook and gain codebook, it is also possible to carry out similar processing for the internal states and prediction coefficients used in the prediction.

Embodiment 3

Figure 9:
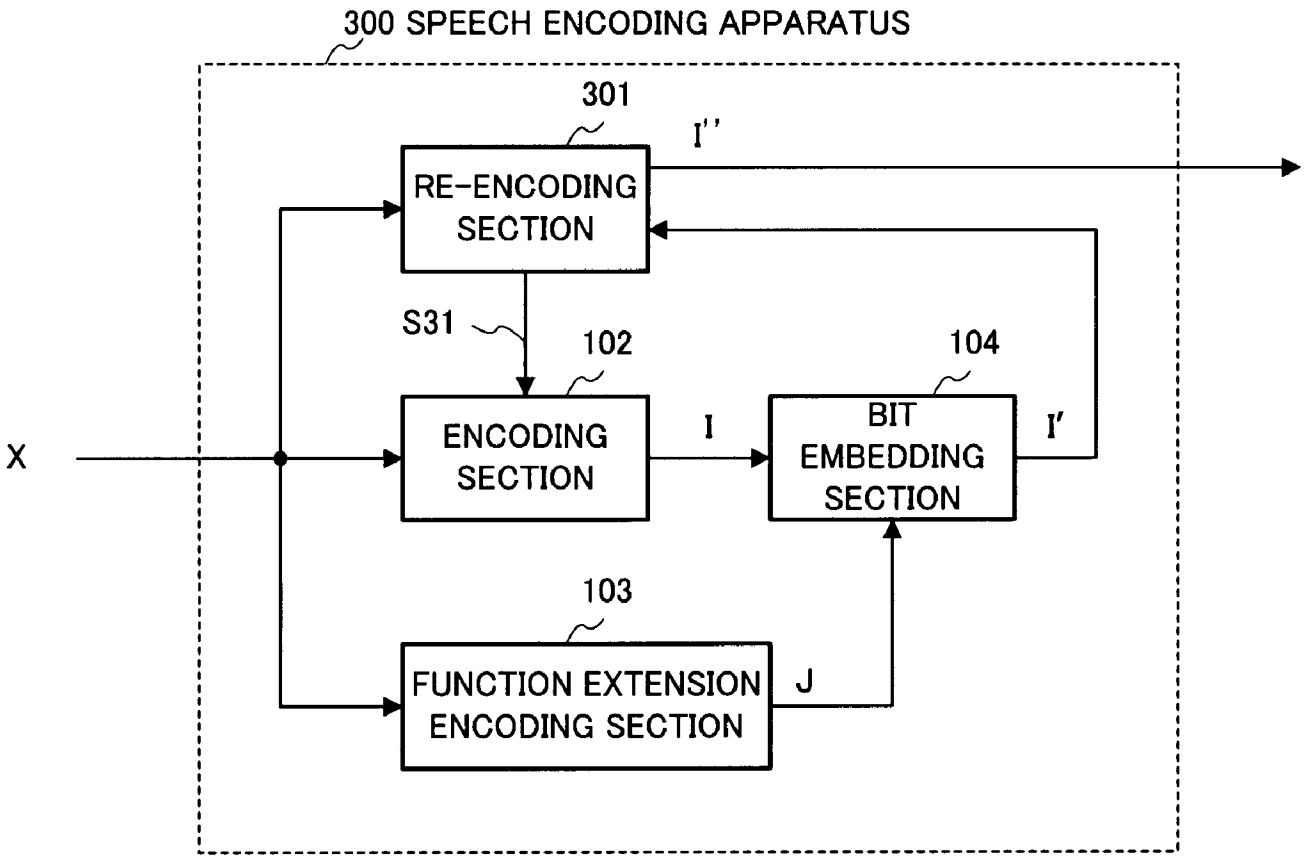
FIG. 9 is a block diagram showing the main configuration of a speech encoding apparatus according to Embodiment 3.

FIG. 9 is a block diagram showing the main configuration of speech encoding apparatus 300 according to Embodiment 3 of the present invention. This speech encoding apparatus 300 has the same basic configuration as speech encoding apparatus 100 shown in Embodiment 1. Components that are identical will be assigned the same reference numerals without further explanations. Here, a case will be described as an example where speech encoding is carried out using the ADPCM scheme.

A feature of this embodiment is to hold information corresponding to extension code J of function extension encoding section 103 as is out of encoded code I' supplied from bit embedding section 104, set the restriction that this information is not to be changed, carry out encoding processing again on encoded code I' at re-encoding section 301 under this restriction, and decide final encoded code I".

Input digital signal X and encoded code I' which is an output of bit embedding section 104 are supplied to re-encoding section 301. Re-encoding section 301 re-encodes encoded code I' supplied from bit embedding section 104. Information corresponding to extension code J out of encoded code I' is eliminated from the encoding target so that no change is applied. The finally obtained encoded code I" is then outputted. As a result, it is possible to hold information of encoded code J of function extension encoding section 103 and generate an optimal encoded code. Further, by supplying to encoding section 102 the prediction coefficients used at the predictive section at this time, the internal state of the predictive section, and the quantization code used one sample previous at the adaptive section, it is possible to synchronize them with the prediction coefficients used at the predictive section of a speech decoding apparatus (not shown) that carries out decoding processing with encoded code I", the internal state of the predictive section, and the quantization code for one sample previous used at the adaptive section, so that it is possible to prevent deterioration in speech quality of the decoded signal.

Figure 10:
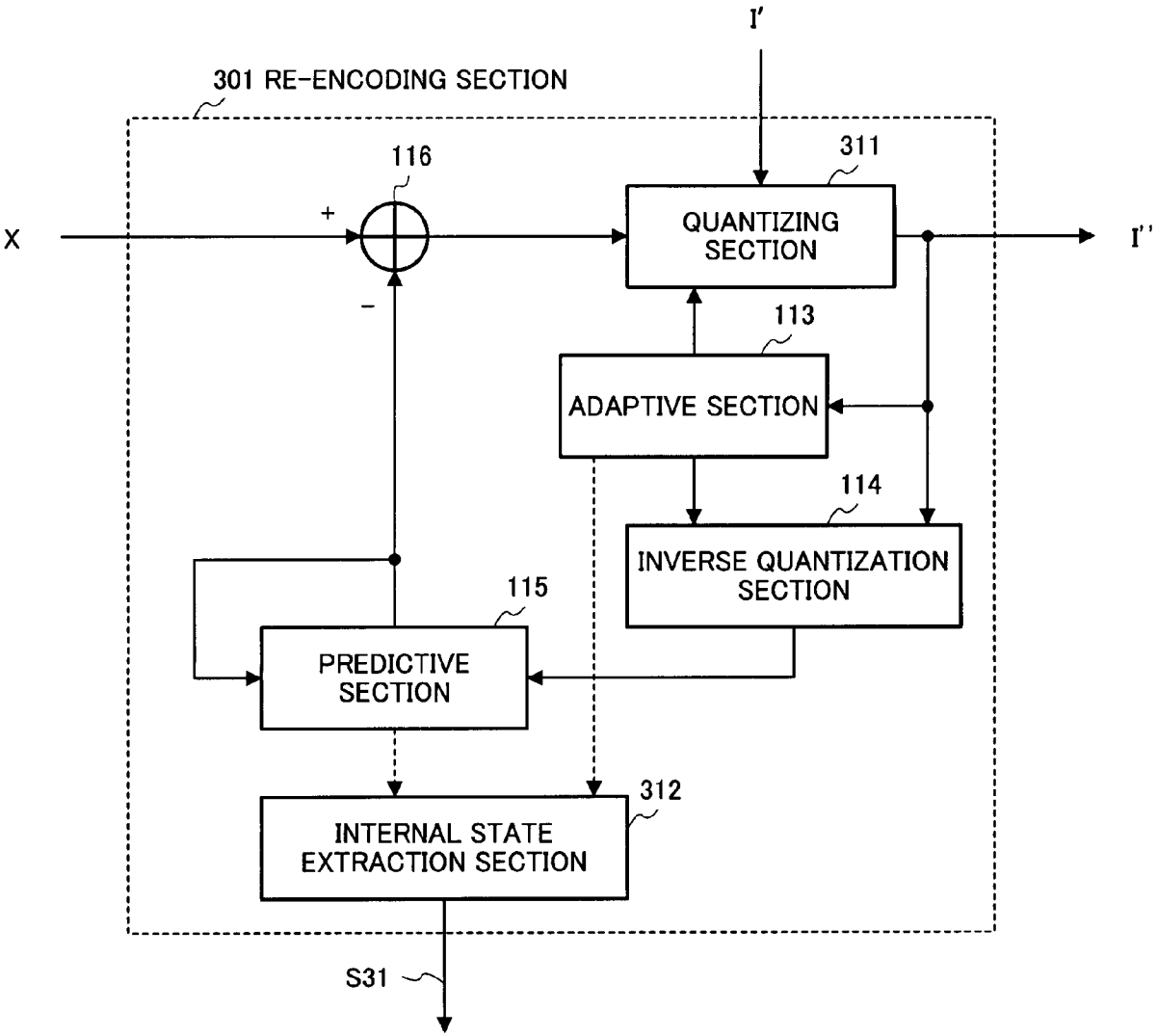
FIG. 10 is a block diagram showing the main configuration within a re-encoding section according to Embodiment 3.

FIG. 10 is a block diagram showing the main configuration within re-encoding section 301. With the exception of quantizing section 311 and internal state extraction section 312, this has the same configuration as encoding section 102 (refer to FIG. 2) shown in Embodiment 1 and is therefore not described.

Encoded code I' generated by bit embedding section 104 is supplied to quantizing section 311. Quantizing section 311 leaves embedded information for encoded code J of function extension encoding section 103 as is, and decides again the other encoded codes.

Figure 11:
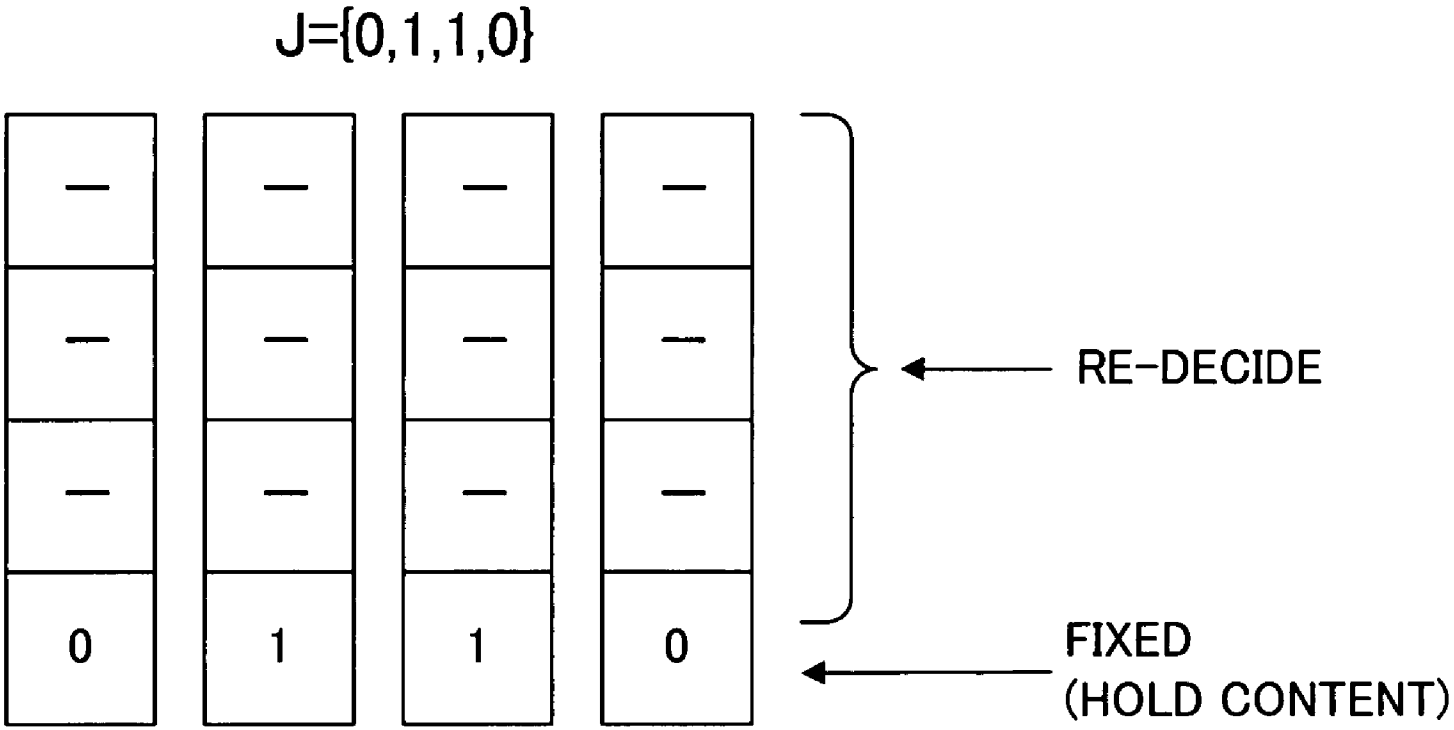
FIG. 11 illustrates an outline of re-deciding processing of a quantizing section according to Embodiment 3.

FIG. 11 illustrates an outline of re-deciding processing of quantization section 311. Here, a case will be described as an example where encoded code J of function extension encoding section 103 is {0, 1, 1, 0}, the encoded code is 4 bits, and encoded code J is embedded in the LSB.

In this case, quantizing section 311 re-decides the encoded code for a quantization value in which distortion becomes minimum with respect to a target residual signal, in a state where the LSB is fixed at encoded code J. As a result, when encoded code J of function extension encoding section 103 is 0, quantization section 311 is capable of adopting eight types of the encoded code for the quantization value, 0x0, 0x2, 0x4, 0x6, 0x8, 0xA, 0xC and 0xD. Further, when J=1, quantization section 311 is capable of adopting eight types of the encoded code for the quantization value, 0x1, 0x3, 0x5, 0x7, 0x9, 0xB, 0xD and 0xF.

In this way, re-decided encoded code I" is outputted, and the internal state of predictive section 115, prediction coefficients used at predictive section 115, and the quantization code of one sample previous used at adaptive section 113 are outputted via internal state extraction section 312. This information is then supplied to encoding section 102 to prepare for next input X.

The procedure of encoding processing according to this embodiment is arranged as follows.

First, encoding section 102 carries out encoding processing. Next, bit embedding section 104 embeds encoded code J supplied from function extension encoding section 103 in encoded code I obtained from encoding section 102, and generates encoded code I'. This encoded code I' is then supplied to re-encoding section 301. Re-encoding section 301 re-decides the encoded code based on the restriction of holding encoded code J, and generates encoded code I". Finally, encoded code I" is outputted, the prediction coefficients used at the predictive section within re-encoding section 301, the internal state of the predictive section, the quantization code of one sample previous used at the adaptive section within re-encoding section 301 are supplied to encoding section 102 to prepare for next input X.

In this way, according to this embodiment, synchronization is achieved between parameters used at the predictive section of the encoding section and parameters used at the predictive section of the decoding section, so that it is possible to prevent the occurrence of deterioration in speech quality. Moreover, an optimum encoding parameter is decided again based on the restriction due to bit-embedded information, so that it is possible to suppress deterioration due to bit-embedding to a minimum.

In this embodiment, a case has been described as an example where speech encoding is carried out using the ADPCM scheme, but it is possible to adopt the CELP scheme.

Figure 12:
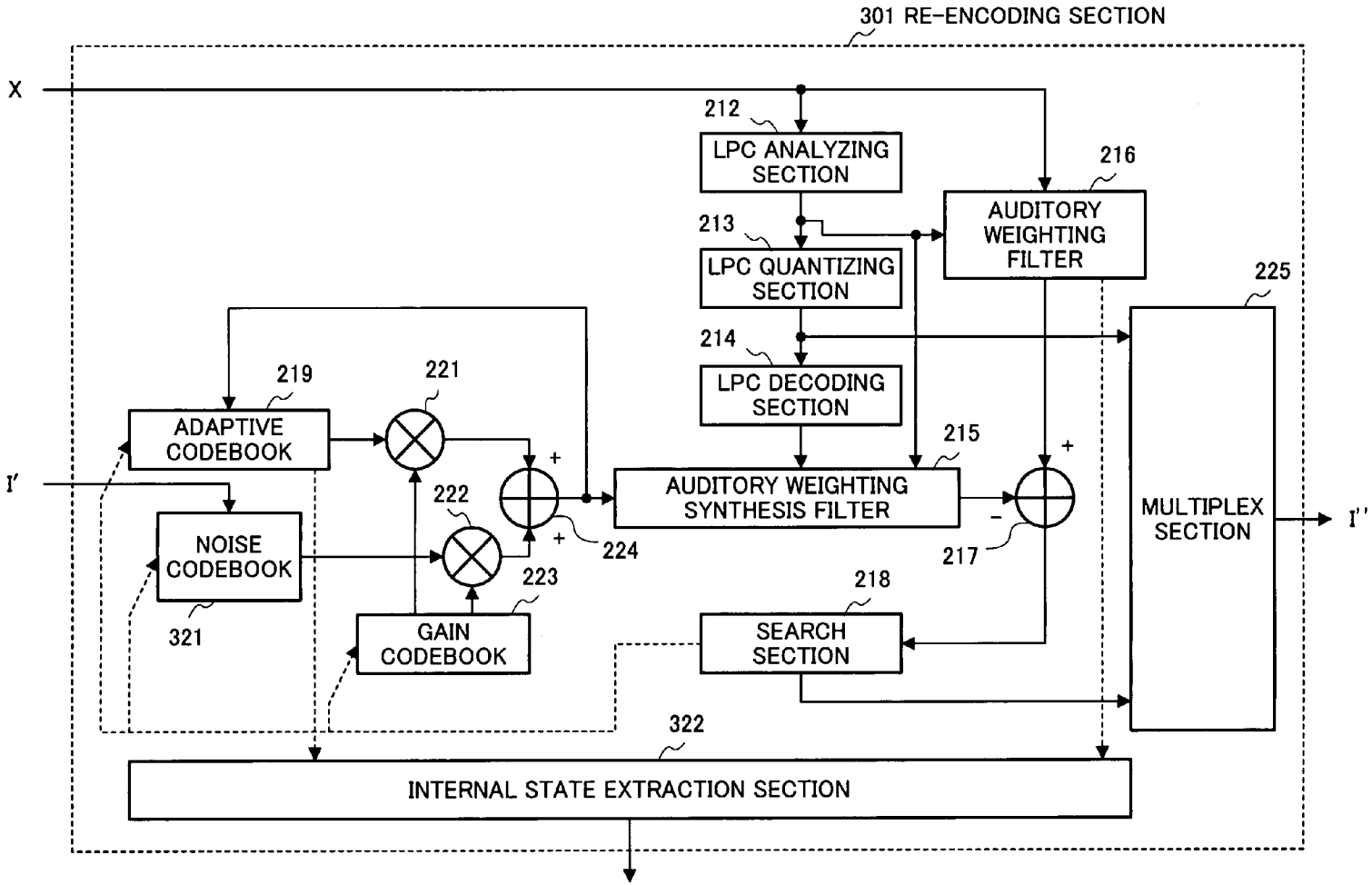
FIG. 12 is a block diagram showing a configuration of the re-encoding section according to Embodiment 3 in the case of using a CELP scheme.

FIG. 12 is a block diagram showing a configuration of re-encoding section 301 in the case of using the CELP scheme. With the exception of noise codebook 321 and internal state extraction section 322, this has the same configuration as encoding section 201 (refer to FIG. 7) shown in Embodiment 2, and therefore a description thereof will be omitted.

Encoded code I' generated by bit embedding section 104 is supplied to noise codebook 321. Noise codebook 321 leaves embedded information for encoded code J as is, and decides again the other encoded codes. When the index of noise codebook 321 is expressed with 8 bits, and information {0} for extension function encoding section 102 is embedded in the LSB, searching of noise codebook 321 is carried out within candidates {2n; n=0 to 127} with the index expressed using an even number. Noise codebook 321 then decides the candidate in which distortion becomes minimum through searching and outputs the index. Similarly, when the index of noise codebook 321 is expressed with 8 bits, and information {1} for extension function encoding section 102 is embedded in the LSB, searching of noise codebook 321 is carried out within candidates {2n+1; n=0 to 127} with the index expressed using an odd number.

Re-encoding section 301 outputs encoded code I" re-decided in this way, and outputs internal states of adaptive codebook 219, auditory weighting filter 216 and auditory weighting synthesis filter 214 via internal state extraction section 322. This information is then supplied to encoding section 102.

In the above description, the case has been described where information for an extension function is embedded in part of the index for noise codebook 321. At this time, it is not necessary for re-encoding section 301 to calculate and encode LPC coefficients, and search the adaptive codebook. The reason for this is that it is a noise codebook that requires re-encoding, and portions processed at the preceding stage are the same as the results at encoding section 102. This is because the results obtained at encoding section 102 may be used as is.

Further, here, the case has been described where information for the extension function is embedded in part of the index for the noise vector, but this is by no means limiting, and, for example, it is also possible to embed information for the extension function in the index for LPC coefficients, adaptive codebook or gain codebook. The principle of operation in this case is the same as described for noise codebook 321 and is characterized in that the index when distortion becomes minimum is re-decided under the restriction of holding information for the extension function.

Here, the case has been described where the internal states of adaptive codebook 219 and auditory weighting synthesis filter 215 are used, but, when prediction is also used in other processing such as LPC decoding, noise codebook and gain codebook, it is possible to carry out similar processing for the internal states and prediction coefficients used in this prediction.

Figure 13:
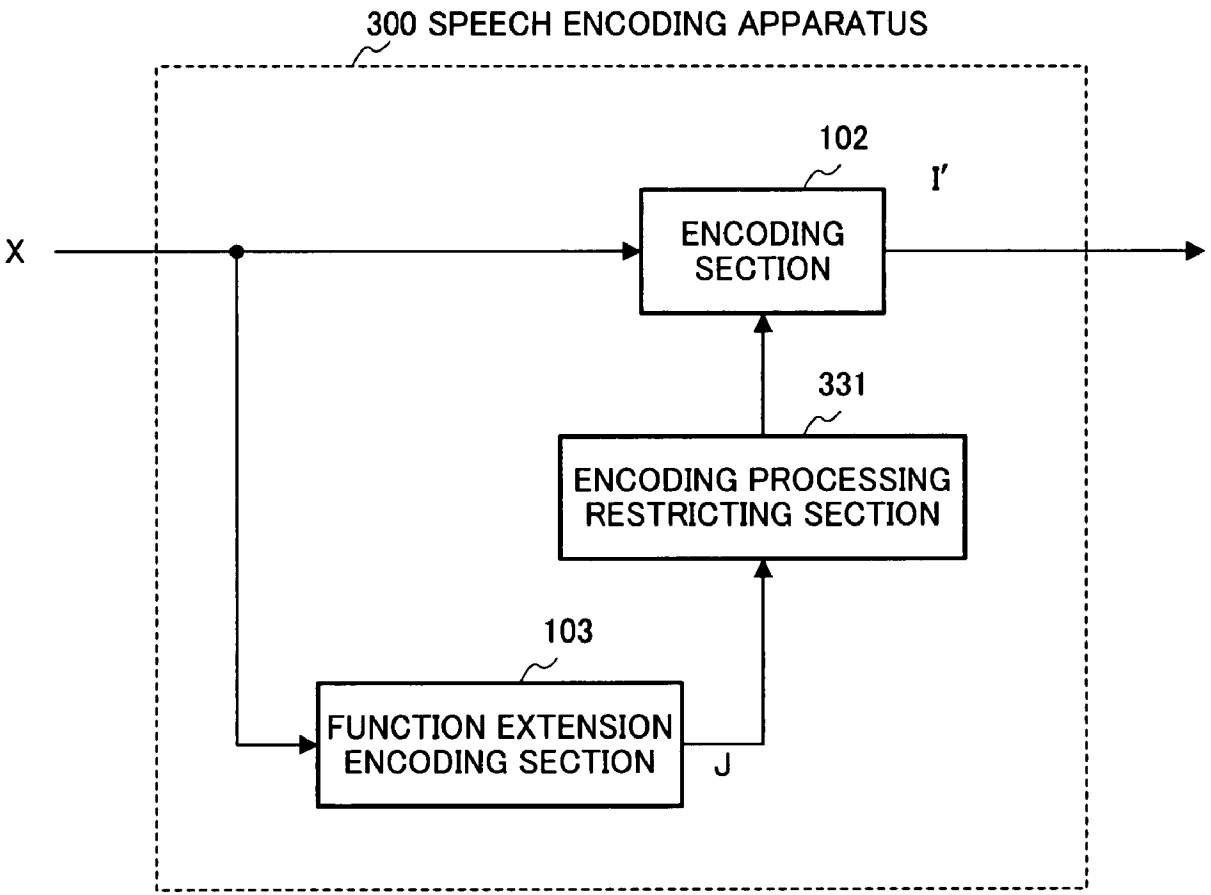
FIG. 13 is a block diagram showing a configuration of a variation of the speech encoding apparatus according to Embodiment 3.

FIG. 13 is a block diagram showing a configuration of a variation of speech encoding apparatus 300.

Speech encoding apparatus 300 shown in FIG. 9 is configured so that the processing result of function extension encoding section 103 changes depending on the processing result of encoding section 102. Here, a configuration is adopted so that processing of function extension encoding section 103 can be carried out independently of the processing result of encoding section 102.

The above configuration can be applied to the case where, for example, an input speech signal is divided into two band (for example, 0-4 kHz, and 4-8 kHz), encoding section 102 encodes 0-4 kHz band, function extension encoding section 103 encodes 4-8 kHz band, independently. In this case, it is possible to carry out encoding processing of function extension encoding section 103 without depending on the processing result of encoding section 102.

When the procedure of this encoding processing is described, first, function extension encoding section 103 carries out encoding processing and generates extension code J. This extension code J is then provided to encoding processing restricting section 331. It is then assumed that extension code J is embedded, and restriction information indicating that information relating to this code J is not to be changed is supplied to encoding section 102 from encoding processing restricting section 331. As a result, encoding section 102 carries out encoding processing under this restriction, and final encoded code I' is decided. According to this configuration, re-encoding section 301 is no longer necessary, so that it is possible to implement speech encoding according to Embodiment 3 with a small amount of calculation.

Each embodiment of the present invention has been described.

The speech encoding apparatus according to the present invention is by no means limited to Embodiments 1 to 3 described above, and various modifications thereof are possible.

The speech encoding apparatus according to the present invention can be provided to a communication terminal apparatus and base station apparatus of a mobile communication system, so that it is possible to provide a communication terminal apparatus and base station apparatus having the same operation results as described above.

Here, although a case has been described as an example in which the present invention is implemented with hardware, the present invention can be implemented with software. For example, by describing the communication relay method algorithm according to the present invention in a programming language, storing this program in a memory and making an information processing section execute this program, it is possible to implement the same function as the speech encoding apparatus of the present invention.

Furthermore, each function block used to explain the above-described embodiments is typically implemented as an LSI constituted by an integrated circuit. These may be individual chips or may partially or totally contained on a single chip.

Furthermore, here, each function block is described as an LSI, but this may also be referred to as "IC", "system LSI", "super LSI", "ultra LSI" depending on differing extents of integration.

Further, the method of circuit integration is not limited to LSI's, and implementation using dedicated circuitry or general purpose processors is also possible. After LSI manufacture, utilization of a programmable FPGA (Field Programmable Gate Array) or a reconfigurable processor in which connections and settings of circuit cells within an LSI can be reconfigured is also possible.

Further, if integrated circuit technology comes out to replace LSI's as a result of the development of semiconductor technology or a derivative other technology, it is naturally also possible to carry out function block integration using this technology. Application in biotechnology is also possible.

This present application is based on Japanese patent application No. 2004-211589, filed on Jul. 20, 2004, the entire content of which is expressly incorporated by reference herein.

INDUSTRIAL APPLICABILITY

The speech encoding apparatus and speech encoding method according to the present invention can be applied to use on a VoIP network and mobile telephone network, and the like.

The invention claimed is:

1. A speech encoding apparatus comprising:

an encoding section that generates a first code from a speech signal using predictive encoding;

an embedding section that embeds additional information in the first code to obtain a second code;

a re-encoding section that re-encodes the speech signal to generate a third code and a predictive parameter used in the predictive encoding using the second code, under restriction of holding the additional information within the second code; and an updating section that updates another predictive parameter held in the encoding section, using the predictive parameter generated in the re-encoding section.

2. The speech encoding apparatus according to claim 1, wherein:

the encoding section generates the first code using an ADPCM (Adaptive Differential Pulse Code Modulation) scheme; and the embedding section embeds the additional information in an LSB (Least Significant Bit) of the first code.

3. The speech encoding apparatus according to claim 1, wherein:

the encoding section generates the first code using a CELP scheme; and the embedding section embeds the additional information in a code indicating a CELP scheme excitation source, out of the first code.

4. The speech encoding apparatus according to claim 1, wherein the embedding section changes a number of bits of the embedded additional information according to a property of the speech signal, and reports the number of bits to a speech decoding apparatus.

5. The speech encoding apparatus according to claim 1, further comprising a designation section that designates a number of bits of the additional information from predetermined options.

6. A communication terminal apparatus comprising the speech encoding apparatus according to claim 1.

7. The communication terminal apparatus according to claim 6, further comprising a transmission section that signals a position where the embedding section embeds the additional information and a number of bits of the additional information.

8. The communication terminal apparatus according to claim 7, wherein the embedding section decides a position for embedding the additional information according to reception conditions of a communication terminal apparatus of a communicating party.

9. A base station apparatus comprising the speech encoding apparatus according to claim 1.

10. The base station apparatus according to claim 9, further comprising a transmission section that signals a position where the embedding section embeds the additional information and a number of bits of the additional information.

11. The base station apparatus according to claim 10, wherein the embedding section decides a position for embedding the additional information according to reception conditions of a communication terminal apparatus of the communicating party.

12. A speech encoding method comprising:

an encoding step of generating a first code from a speech signal using predictive encoding;

an embedding step of embedding additional information in the first code to obtain a second code;

a re-encoding step of re-encoding the speech signal to generate a third code and a predictive parameter used in the predictive encoding using the second code, under restriction of holding the additional information within the second code; and an updating step of updating another predictive parameter used in the encoding step, using the predictive parameter.

* * * * *